US010494149B2

(12) United States Patent
Kunz

(10) Patent No.: US 10,494,149 B2
(45) Date of Patent: Dec. 3, 2019

(54) PLASTIC TUBE

(71) Applicant: ALPLA WERKE ALWIN LEHNER GMBH & CO. KG, Hard (AT)

(72) Inventor: Johann Kunz, Hard (AT)

(73) Assignee: Alpla Werke Alwin Lehner GMBH & Co. KG, Hart (AT)

( * ) Notice: Subject to any disclaimer, the term of this patent is extended or adjusted under 35 U.S.C. 154(b) by 0 days.

(21) Appl. No.: 15/771,383

(22) PCT Filed: Oct. 26, 2016

(86) PCT No.: PCT/EP2016/075829
§ 371 (c)(1),
(2) Date: Apr. 26, 2018

(87) PCT Pub. No.: WO2017/072188
PCT Pub. Date: May 4, 2017

(65) Prior Publication Data

US 2018/0346203 A1 Dec. 6, 2018

(30) Foreign Application Priority Data

Oct. 27, 2015 (CH) ..... 01569/15

(51) Int. Cl.
*B65D 35/24* (2006.01)
*B65D 79/00* (2006.01)

(52) U.S. Cl.
CPC ..... *B65D 35/24* (2013.01); *B65D 79/005* (2013.01)

(58) Field of Classification Search
CPC ... B65D 35/24; B65D 79/005; B65D 2205/00
USPC ..... 222/189.09
See application file for complete search history.

(56) References Cited

U.S. PATENT DOCUMENTS

| | | | | |
|---|---|---|---|---|
| 2,686,615 | A * | 8/1954 | Stocker | B65D 35/24 126/377.1 |
| 6,135,322 | A | 10/2000 | Cetrangolo | |
| 7,150,376 | B2 * | 12/2006 | Tsai | B65D 83/0055 222/95 |
| 2010/0044397 | A1 | 2/2010 | Pang | |
| 2011/0103714 | A1 | 5/2011 | Steele et al. | |
| 2013/0193166 | A1 * | 8/2013 | Decottignies | B65D 47/2081 222/189.09 |

(Continued)

FOREIGN PATENT DOCUMENTS

| | | |
|---|---|---|
| DE | 19859441 | 6/2000 |
| EP | 1068902 | 1/2001 |

(Continued)

*Primary Examiner* — Jeremy Carroll
(74) *Attorney, Agent, or Firm* — Morriss O'Bryant Compagni Cannon, PLLC

(57) ABSTRACT

The invention proceeds from a tube produced from a plastics material, having a tube body, which has a first end and a second end, having a tube head, which is connected to the tube body at the first end and has a removal opening, and having a tube fold which is formed at the second end and has a first sealing surface and a second sealing surface, wherein the first and the second sealing surfaces are connected to one another in a fluid-tight manner. According to the invention, the sealing surfaces have arranged between them a retaining insert, which is connected to the first sealing surface and the second sealing surface in a fluid-tight manner.

15 Claims, 3 Drawing Sheets

(56) References Cited

U.S. PATENT DOCUMENTS

2014/0197207 A1 7/2014 Pozzi

FOREIGN PATENT DOCUMENTS

| | | |
|---|---|---|
| EP | 1944241 | 7/2008 |
| WO | WO2010081081 | 7/2010 |

* cited by examiner

PLASTIC TUBE

CROSS-REFERENCE TO RELATED APPLICATIONS

This application is a national phase entry under 35 U.S.C. § 371 of PCT/EP2016/075829 filed on Oct. 25, 2016, which claims priority to Swiss Patent Application 01569/15 filed on Oct. 27, 2015, the entirety of each of which is incorporated by this reference.

FIELD OF THE INVENTION

The invention relates to a tube produced from a plastics material.

PRIOR ART

If containers are filled with hot liquids or other contents and sealed immediately after the filling procedure, this results in a negative pressure in the inside of the container after cooling, whereby the walls of the container can partially collapse. Such containers are aesthetically unsightly and cannot be placed on the shelves in this state. In order to prevent the collapse of the walls, the containers are equipped with a vent valve. This can be produced from an air-permeable, porous material. The vent valve is generally integrated into the closure cap because it can be installed most easily there. Vent valves made from porous materials can also serve, however, to protect the contents of the container from microbes and bacteria. From design- or function-technical reasons, an arrangement of the vent valve in the closure of the container is not always the optimal location. There is, therefore, the need to allow a greater flexibility in the arrangement of the vent valve.

In any case, the problem also arises on thin-walled containers, such as tubes, that can be reversibly deformed with little force if the product is filled at a low atmospheric pressure and sealed air-tight and the sale of these tubes occurs at a location having a higher atmospheric pressure. Although this deformation has no effect on the product located within the interior of the container, these containers are mostly unsellable.

A closure cap is known from WO 2010/081081, in which a porous element is integrated in order to enable a pressure equalization between the container interior and the environment. The closure cap according to WO 2010/081081 has a chamber on the underside of the lid that has two openings, a lower opening, through which the porous element is inserted into the chamber, and an upper passage opening, which connects the chamber to the environment. In order to retain the porous element in the chamber, this can be dimensioned in such a manner that a snug fit is realized. Alternatively, the lower edge of the chamber can be folded or provided with an undercut.

EP-A-1 068 902 discloses a closure arrangement comprising an elastic stopper to seal a container opening and a filter medium that is integrated into the stopper. The stopper has an axial opening that allows a connection between the container interior and the environment. A filter disc is arranged in the opening of the stopper that is placed in a sealing manner on the cylindrical wall of the passage. It is proposed to integrally form the filter disc in the opening with the stopper in an injection-molding process. In any case, EP-A-1 068 902 gives no instructions as to how this could be accomplished.

For design-technical or functional reasons, an arrangement of the vent valve in the closure of the container is not always the optimal location.

ADVANTAGE OF THE INVENTION

The present invention provides a retaining device for functional elements on a plastic tube that can be provided at a different location than the container closure, in order, for example, to permit a pressure exchange between the interior space of the tube and an atmosphere surrounding the tube.

SUMMARY OF THE INVENTION

The invention relates to a tube produced from a plastics material. A tube comprises in a known manner a tube body having a first and a second end, a tube head connected to the tube body on its first end having an outlet, and a tube fold formed on the second end, which, in turn, has first and second sealing surfaces welded together.

A tube according to the present invention provides a retaining insert arranged between the two sealing surfaces which is connected in a fluid-tight manner to the first sealing surface and the second sealing surface. The retaining insert is simply and reliably held in the tube fold because it is welded to the sealing surfaces when the tube is closed, in any case, without having to be connected together in a fluid-tight manner. The position of the functional element opposite the tube head is particularly advantageous because air sucked in through the retaining insert can be used to press the remaining product out of the tube head. Tubes equipped with the retaining insert can therefore be emptied of residues. The fluid-tight connection can be produced by means of adhesive bonding or welding. If the tube is adhesively bonded, the adhesive can be supplied from the outside or already be applied to retaining insert/interior of the sealing surfaces. The adhesion or welding can be accomplished by heating. In UV-transparent materials, the adhesion can also be accomplished by means of UV-curing adhesive. The sealing surfaces can be only partly provided in the joining region with coatings such as a bonding agent or a hot-melt adhesive, which can be applied by spraying, rolling or as a tape band. In general, bonding agents and hot-melt adhesive have a lower melting point than the plastic of the blank from which the container is made. The bonding agent or hot-melt adhesive can also be textured. Insertion pieces that would not bond with the container by welding can also be connected to the container by means of the bonding agent or hot-melt adhesive. Sealing surface is to be understood in the first approach as the welding or adhesion surface that, as described above, can comprise coatings. The container itself can be designed as one layer or multiple layers so that barrier coatings such as EVOH or PA, for example can be formed in the container. The adhesive coating can be applied only to the retaining element if this is adapted to the sealing surfaces of the tube. Generally, a non-detachable connection of the sealing surfaces is created. Furthermore, the first end and the second end are opposite each other. For example, on the finished tube, the tube fold and a longitudinal axis of the tube can enclose an arbitrary angle that can also be larger than 0° and smaller than 180°. This angle can, for example, be 90°, 45° or 30°. Further, the tube fold does not necessarily have to be formed straight to the finished tube. It can, for example, also be designed in a wavy or sine-curve shape.

In another embodiment, the retaining insert has a support element that can be designed as a central part and at least one end part, wherein the support element tapers down to the at least one end part, whereby it has a streamlined shape. The streamlined shape permits the sealing surfaces to have contact with the retaining insert at each point and without leaks between sealing surfaces and retaining insert. The end part is customarily tapered, while the support element is curved. This allows the end part to transition steplessly into the tube fold. The support element can be curved, or smoothly curved. The support element can also form a corner of the fold, wherein this corner can be designed not pointed, but as a rounded corner. Typically, the retaining insert is formed transversely to the extension direction of the fold, essentially as a straight circular cylinder, so that the streamlined shape is essentially formed by a two-dimensionally bent surface. Two end parts can also be formed on the support element. The two end parts are usually located opposite one another, but can also enclose an angle that is smaller than 180° and larger than 0°.

Functionally, at least one welded rib is formed on the retaining insert partly along a longitudinal extension of the sealing surfaces. In general, the welded rib, which is formed on the retaining insert as a ridge extending in the direction of at least one of the sealing surfaces, is formed on the side facing the first sealing surface as well as on the side of retaining insert facing the second sealing surface. The amount of heat to be applied for welding is reduced by the welded ribs so that less heat is introduced into the tube as a whole. More than one welded rib can be arranged on one side of the retaining insert, wherein the welded ribs generally have the same shape and are separated from each other. The provision of more than one welded rib ensures that no leaking welds arise between sealing surfaces and retaining insert. If one welded rib has a leaking point, the other welded rib is with high probability sealed. In order to increase the security, more than two welded ribs can also be provided on the retaining insert.

Advantageously, a functional element is fixed to the retaining insert. The functional element can be formed in or on the retaining insert. Not only a membrane, but a filter made from a porous material, a shelf-life indicator, a reservoir dispensing a chemical into the tube interior or a stopper having a tube can also be arranged in the functional element. This list of possible functional elements is not exclusive and can be freely expanded.

It is particularly advantageous if the retaining insert has at least one passage opening in order to effect a fluid exchange between an interior space of the tube and an atmosphere surrounding the tube. The passage opening makes a gas exchange between tube interior and environment possible. This is advantageous if a gas arising in the tube is to be discharged into the environment, or if air from the environment is to be sucked into the tube.

Advantageously, the ratio of a maximum thickness of the support element, which extends between the first sealing surface and the second sealing surface, to a length of the retaining insert, which extends along the sealing surfaces, is between 1:1 and 1:10 or between 1:2 and 1:4. By means of this, the curvature of the retaining insert is not too pronounced, whereby the sealing surfaces can rest completely on the retaining surface.

By virtue of the fact that an extension that extends into the interior of the tube and that can be non-detachably connectible is formed on the retaining insert, the functional element can also be arranged in the tube interior. The functional element can be screwed, plugged into or adhesively bonded onto the retaining insert. These connection possibilities can be produced quickly and hold permanently. The functional element can be an indicator that changes its color, for example, if the product has exceeded a specified storage temperature or its average durability. In the case of sun creams, for example, the functional element can signal if the sun protection factor has been reduced by a specified value. The functional element can further be produced from a sintered material, such as plastic, in order to effect a pressure equalization between the interior of the tube and the atmosphere.

In another embodiment, a membrane is arranged in the functional element. The membrane is fluid-tight and only gas-permeable in one direction. In this manner, air from the environment can be sucked in or gas from the tube interior can be expelled into the environment. By the arrangement of the membrane in the functional element, the functional element can be connected to the retaining insert without having to disturb the integrated membrane. This leads to an increased process security because a destruction or a damage of the membrane during installation in the retaining insert is reliably prevented. The membrane, for example produced by the Gore company, has a pore size that allows an air or gas exchange between interior and atmosphere but reliably prevents an exit of material stored in the interior through the passage opening.

In another exemplary embodiment, the functional element is formed as a membrane. In an advantageous manner, the functional element can also be configured to seal the passage opening.

In an advantageous manner, the retaining insert is produced from a material that can be connected to the material of the sealing surface in a fluid-tight manner. In general, the retaining insert and sealing surface are produced from plastic. By virtue of the fact that the plastics of the sealing surface and of the retaining insert merge into one another during welding, their connection is usually permanently sealed.

Functionally, at least one opening having an aperture cross-sectional area of less than 350 $\mu m^2$ is provided in the retaining insert. This aperture cross-sectional area can be adapted so that paste-like products, in particular, do not escape into the environment through the opening; however, an air exchange, with respect to pressure equalization, can nonetheless take place between the interior of the tube and the atmosphere. In addition, a functional element can also be provided. The shapes of the opening can comprise round, oval, rectangular or any other desired geometrical shape. If the opening is a hole, a diameter of less than 25 μm is desired.

Functionally, at least one opening having an aperture cross-sectional area smaller than 20 $\mu m^2$ is provided on the retaining insert. This aperture cross-sectional area can be adapted so that fluid product, in particular, does not escape into the environment through the opening; however, a gas or air exchange, with respect to pressure equalization, can nonetheless take place between the interior of the tube and the atmosphere. In addition, a functional element can also be provided. The shapes of the opening can comprise round, oval, rectangular or any other desired geometrical shape. If the opening is a hole, a diameter of less than 5 μm is desired.

In yet another embodiment, the retaining element has a first fastening element accessible from the outside that can be connected to a second retaining element corresponding to the first fastening element. The attachment of the second mounting element to the first mounting element can be executed in a detachable or non-detachable manner, for example via push-button technology or expanding rivet technology or screw connection. The second mounting element can be non-detachably connected to the mounting element to be attached. This element can be a loop or a hook, for example. In this manner, a tube having shower gel, for example, can be hung up in the shower by means of the hook or loop, for example on the shower rod. The shower gel thus flows into the head space during storage and is available for immediate removal.

It is shown to be advantageous if the functional element has formed a smaller-diameter collar and a larger-diameter flange. In this manner, a membrane can be easily arranged in the flange. The section between collar and flange is also advantageous in order to hold the functional element in a form-locking manner in the retaining insert.

In yet another embodiment, the passage opening comprises a projection formed on its interior wall. The projection serves to hold the retaining insert in a form-locking manner, in that the section between collar and flange strikes against other projections if an overpressure presses the functional element in the direction of the tube interior or the tube exterior.

Further advantages and features of the invention are derived from the following description of an exemplary embodiment of the invention with reference to the attached drawings. In an illustration not drawn to scale, these show:

DETAILED DESCRIPTION OF THE INVENTION

Figure 1:
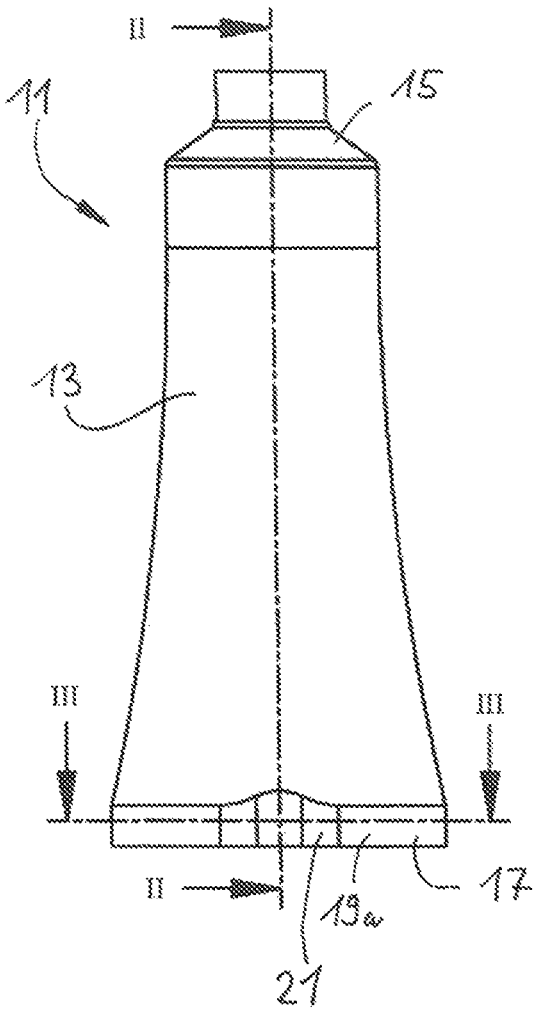
FIG. 1: a side view of a proposed tube.
Figure 2:
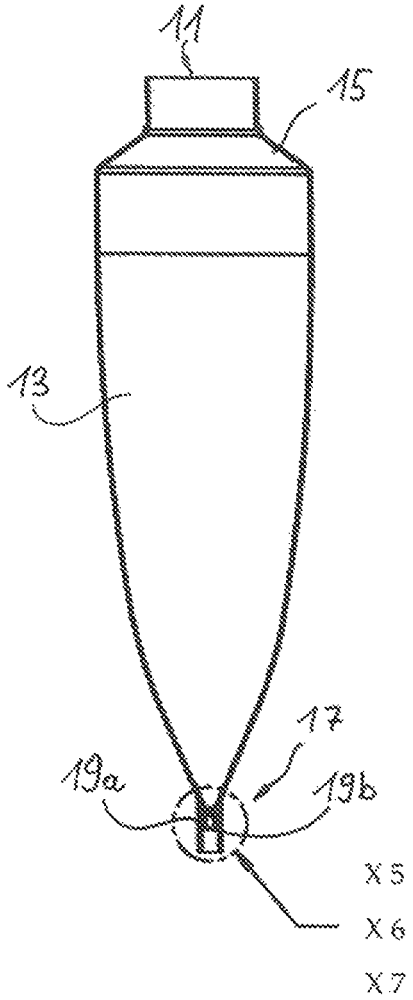
FIG. 2: a sectional view through the tube from FIG. 1 along a cut line II-II.
Figure 4:
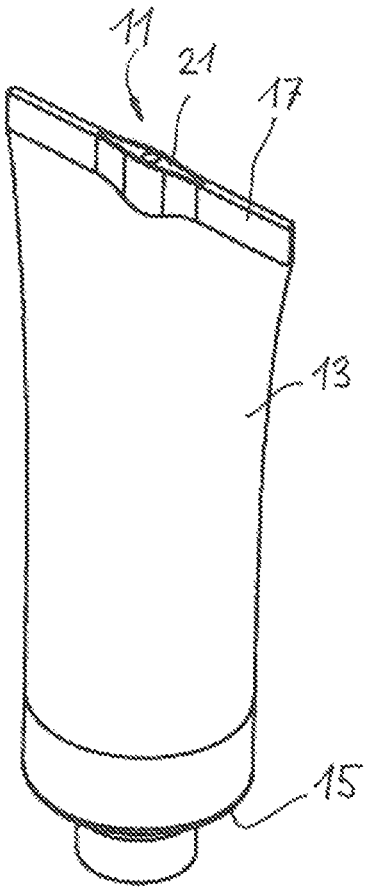
FIG. 4: a perspective view of the proposed tube.

A proposed tube is shown in FIGS. 1, 2 and 4 that is designated as a whole with reference character 11. The tube body 13 has a first and a second end. The first end is connected to a tube head 15 or is formed as such. The second end is designed as a tube fold 17 that closes the second end of the tube body in a fluid-tight manner. For this purpose, first and second sealing surfaces 19*a*, 19*b* of tube fold 17 are welded to one another.

Figure 3:
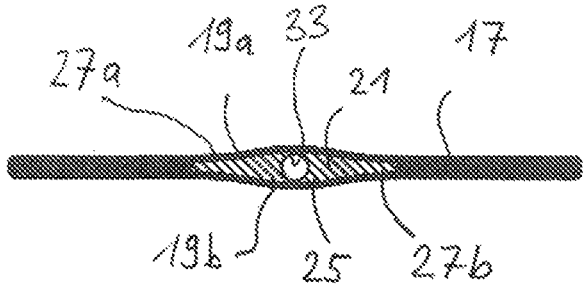
FIG. 3: a sectional view through the tube from FIG. 1 along a cut line III-III.
Figure 5:
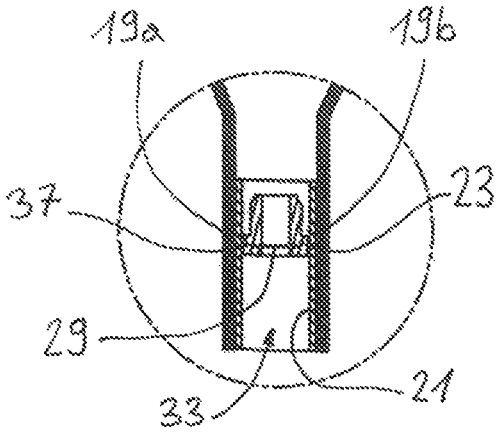
FIG. 5: an enlarged view of a retaining insert in a first embodiment.
Figure 6:
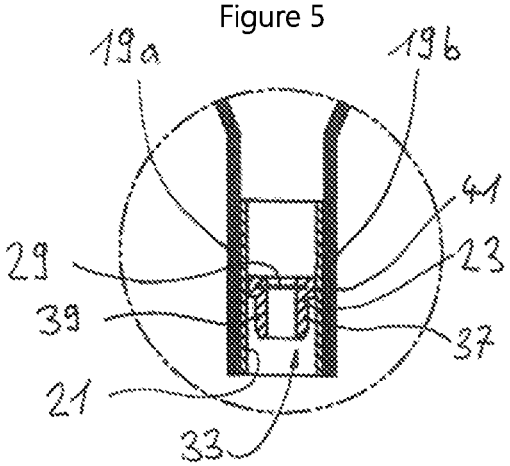
FIG. 6: an enlarged view of a retaining insert in a second embodiment.
Figure 7:
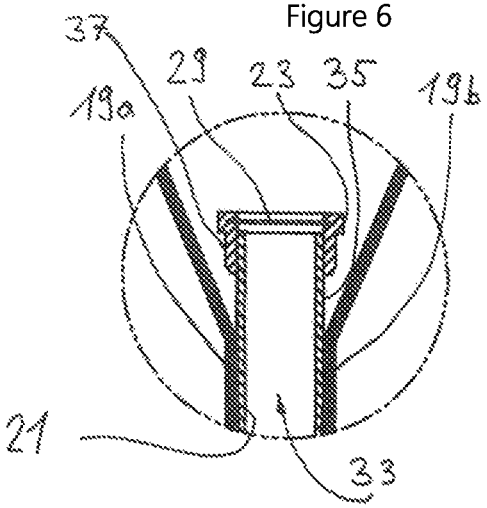
FIG. 7: an enlarged view of a retaining insert in a third embodiment.

As can be better seen in FIGS. 5 to 7, a retaining insert 23 for retaining a functional element 23 is arranged between the two sealing surfaces 19*a*, 19*b*. Retaining insert 21 is arranged in the present embodiment centrally between the two sealing surfaces 19*a*, 19*b*. In order that the two sealing surfaces 19*a*, 19*b* can completely rest on retaining insert 21, retaining insert 21 tapers from its central part 25, which is designed as a support element, to its two opposing end parts 27*a*, 27*b*, as can be seen in FIG. 3. The two sealing surfaces 19*a*, 19*b* are therefore continuously widened from the two end parts 27*a*, 27*b* up to the center part 25. A fluid-tight transition between sealing surfaces 19*a*, 19*b* and the retaining insert is ensured by the streamlined shape of retaining insert 21.

Two welded ribs not shown here extend on each longitudinal side at a distance from one another along the longitudinal sides of retaining insert 21 facing the two sealing surfaces 19*a*, 19*b*. By means of the doubled implementation of the welded ribs, the security per longitudinal side is increased so that the welded connection between tube fold 17 and retaining insert 21 is fluid tight. It is obvious that retaining insert 21 is produced from a plastic that can be welded to sealing surfaces 19*a*, 19*b*.

Retaining insert 21 holds functional element 23 that can perform different tasks. A membrane 29 (FIGS. 5 to 7) is arranged in functional element 23. The functional element, for example in the form of a filter 31 (FIGS. 8 and 9), can be formed in retaining insert 21. In the region of the center 25, a passage opening 33 is provided so that the membrane 29 or the filter 31 is in communication with the tube interior and the environment. The membrane offers the advantage that the tube can be completely emptied. The rest of the product, which remains in the tube head in the case of customary tubes, can be pressed out in the case of tube 11 according to the invention because air can be sucked from the outside through membrane 29 or filter 31. By using the sucked-in air, the rest of the product can be pressed out of tube body 15. Membrane 29 or filter 31, however, also serves to counter tube deformations that can be caused by filling with a hot product or by a change of the air pressure (different elevations above standard elevation zero).

In order to obtain as long a sealing surface as possible between welded ribs and sealing surfaces 19*a*, 19*b*, it is desired that the ratio of the thickness of the central part to the length of the retaining insert amounts to at least 1:2. In order to be able to arrange membrane 29 or filter 31 in the tube interior, these can also be arranged on an extension 35. Membrane 29 is mounted in a housing 37 for attachment in or on functional element 23. For simplified insertion into retaining insert 21, housing 37 has a smaller-diameter collar 39 and a larger-diameter flange 41. Membrane 29 is thus arranged inside flange 41. Housing 37 with collar 39 (FIG. 5) or flange 41 (FIG. 6) can be inserted into retaining insert 21 in advance. Housing 37 can also be plugged into or screwed onto extension 35 (FIG. 7).

Figure 8:
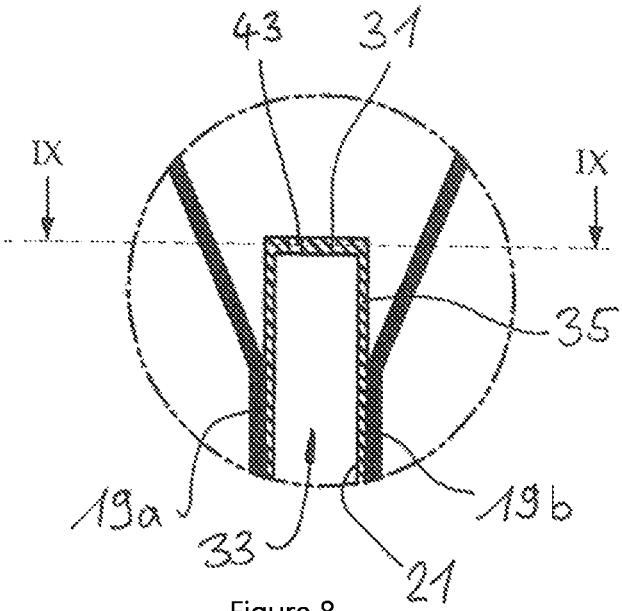
FIG. 8: an enlarged view of a retaining insert in a fourth embodiment.
Figure 9:
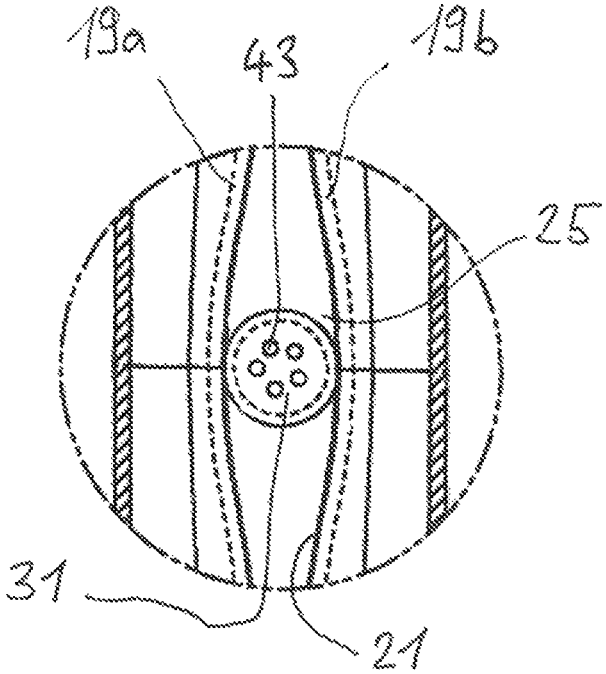
FIG. 9: a sectional view along a cut line IX-IX in FIG. 8.

It can be seen from FIG. 8 that extension 35 can have a floor that acts as filter 31 in that fine filter pores or filter openings 43 are provided in the floor. The diameters of filter pores 43 are adapted to the viscosity of the product filled into tube 11 and are smaller than 25 μm (for viscous products) or 5 μm (low-viscosity products), so that the filter can be penetrated by gaseous media, but not by the packaged products. In FIG. 9, a top view of extension 35 is shown along the cut line IX-IX, in which a possible circular arrangement of filter pores 43 can be seen.

The invention claimed is:

1. A plastic material tube, comprising:

a tube body having a first end and a second end;

a tube head having a removal opening connected to the tube body at the first end;

a tube fold formed at the second end of the tube body, the tube fold having a first sealing surface and a second sealing surface, wherein the first and second sealing surfaces are connected to each other in a fluid-tight manner; and a retaining insert positioned between and connected to the first and second sealing surfaces in a fluid-tight manner.

2. The tube according to claim 1, wherein the retaining insert comprises a support element and at least one end part, wherein the support element tapers to the at least one end part and has a streamlined shape.

3. The tube according to claim 2, wherein a ratio of a maximum thickness of the support element that extends between the first sealing surface and the second sealing surface to a length of the retaining insert that extends along the first and second sealing surfaces is between 1:1 and 1:10.

4. The tube according to claim 3, wherein the ratio is between 1:2 and 1:4.

5. The tube according to claim 1, wherein the retaining insert further comprises at least one welded rib at least partly along one longitudinal extension of the first and second sealing surfaces.

6. The tube according to of claim 1, further comprising a functional element fixed to the retaining insert.

7. The tube according to claim 6, wherein the retaining insert defines at least one passage opening to affect a fluid exchange between an interior space of the tube body and an atmosphere surrounding the tube body.

8. The tube according to claim 7, wherein the functional element is configured to close the passage opening.

9. The tube according to claim 6, wherein an extension extends into the interior space of the tube, is formed on the retaining insert and is non-detachably connected to the functional element.

10. The tube according to claim 6, further comprising a membrane arranged in the functional element.

11. The tube according to claim 6, wherein the functional element is comprised of a membrane.

12. The tube according to claim 1, wherein the retaining insert is comprised of a first material that can be connected in a fluid-tight manner to a second material of the sealing surfaces.

13. The tube according to claim 1, wherein the retaining element defines at least one opening having an aperture cross-sectional area smaller than 350 $\mu m^2$.

14. The tube according to claim 13, wherein the aperture cross-sectional area is smaller than 20 $\mu m^2$.

15. The tube according to claim 1, wherein the retaining element comprises a first fastening element accessible from an outside thereof and is connectable to a second retaining element corresponding to the first fastening element.

* * * * *